US006372025B1

(12) United States Patent
Burlatsky et al.

(10) Patent No.: US 6,372,025 B1
(45) Date of Patent: Apr. 16, 2002

(54) PARTICULATE CONTROL SYSTEMS INCORPORATING ELECTROSTATIC PRECIPITATORS

(75) Inventors: Sergei F. Burlatsky, Cambridge; Bruce H. Easom, Groton, both of MA (US)

(73) Assignee: LSR Technologies, Inc., Acton, MA (US)

( * ) Notice: Subject to any disclaimer, the term of this patent is extended or adjusted under 35 U.S.C. 154(b) by 0 days.

(21) Appl. No.: 09/392,487

(22) Filed: Sep. 9, 1999

(51) Int. Cl.[7] ..... B03C 3/011

(52) U.S. Cl. ..... 96/60; 55/340; 55/343; 55/344; 55/417; 55/484; 96/73

(58) Field of Search ..... 55/343, 344, 346, 55/347, 484, 417, 340, 338; 96/60, 62, 73, 63, 55–57; 95/78

(56) References Cited

U.S. PATENT DOCUMENTS 2,554,247 A * 5/1951 Hedberg ..... 96/73
2,659,449 A * 11/1953 Kaiser et al. ..... 96/73 X
2,758,666 A * 8/1956 Prentiss ..... 96/73 X
3,318,070 A * 5/1967 Zeiss et al. ..... 55/343 X
3,631,655 A * 1/1972 Mullen ..... 55/344 X
3,964,883 A * 6/1976 Nakao ..... 55/338 X
4,255,169 A * 3/1981 Leliaert et al. ..... 55/340 X
4,622,051 A * 11/1986 Polach et al. ..... 55/338 X
5,120,333 A * 6/1992 Davis ..... 55/338
5,180,486 A 1/1993 Smolensky et al. ..... 210/195.1
5,591,253 A 1/1997 Altman et al. ..... 96/61
5,683,494 A 11/1997 Altman et al. ..... 96/55
5,863,316 A * 1/1999 Lordo et al. ..... 55/338 X
5,961,693 A * 10/1999 Altman et al. ..... 95/78

* cited by examiner

*Primary Examiner*—Richard L. Chiesa
(74) *Attorney, Agent, or Firm*—Marshall, Gerstein, & Borun

(57) ABSTRACT

A particulate control system which includes a collector such as an electrostatic precipitator (ESP) is improved by incorporation of a collector, such as an electrostatically enhanced separator (EES) connected parallel with the collector and wherein the output flow from the collector is split and a portion of the output flow from the collector is directed through the separator. The input flow to the collector may also be split so that a portion is directed to the separator as well as the collector. A bleed line may also be employed to connect the separator to the collector resulting in a bleed flow from the separator to the collector.

11 Claims, 4 Drawing Sheets

——— CURRENT ESP EFFICIENCY

- - - - - - TARGET SYSTEM EFFICIENCY CORRESPONDING TO 10% OPACITY LEVEL

- - - - - - SYSTEM EFFICIENCY-ESP TREATS 690000 acfm

—·—·— SYSTEM EFFICIENCY-ESP TREATS 590000 acfm

— — — SYSTEM EFFICIENCY-ESP TREATS 490000 acfm

PARTICULATE CONTROL SYSTEMS INCORPORATING ELECTROSTATIC PRECIPITATORS

FIELD OF THE INVENTION

The present invention relates generally to improvements in particulate control systems and, more particularly, to improvements in particulate control systems that incorporate electrostatic precipitators.

BACKGROUND OF THE INVENTION

U.S. Pat. Nos. 5,591,253 and 5,683,494 disclose the use of electrostatically enhanced separators (EES) for separating particles from gas streams. Specifically, these patents disclose the use of an EES in conjunction with collectors such as cyclone collectors, bag filters and electrostatic precipitators. However, these patents only disclose the use of an EES in series or in a common loop with other mechanical or electrostatic separators.

Electrostatic precipitators (ESPs) and other collectors are commonly used in electric power generating stations. It has been found that high-resistivity ash produced by burning low-sulfur coals reduces the particulate collection efficiency of electrostatic precipitators (ESPs and other collectors as well). As a result, there is a demand by utilities for low cost improvements to particulate control systems utilizing electrostatic precipitators.

SUMMARY OF THE INVENTION

The present invention satisfies the aforenoted needs by providing an apparatus for separating particles from a gas stream that comprises an input line connected to a collector as well as a separator. The collector may be an electrostatic precipitator, cyclone collector, bag filter or other suitable collecting device. The separator may be an electrostatically enhanced separator or other suitable separating device. Downstream of the collector, the collector is connected to a flow distribution valve such as a splitter valve or divider valve. The flow distribution valve connects the collector to an outlet line and a return line. The return line connects the flow distribution valve to the separator so that a portion of the outlet from the collector is returned to the separator. The flow distribution valve divides the output stream from the collector into first and second portions whereby the first portion flows through the outlet line and the second portion flows through the return line to the separator.

In an embodiment, the collector comprises at least one electrostatic precipitator.

In an embodiment, the separator comprises at least one electrostatically enhanced separator as described in U.S. Pat. Nos. 5,591,253 and 5,683,494.

In an embodiment, the apparatus further comprises a second flow distribution valve disposed upstream of both the collector and the separator. The second flow distribution valve connects the input line to the collector and the separator. The second flow distribution valve divides the gas stream into a third portion flowing to the collector and a fourth portion flowing to the separator.

In an embodiment, the apparatus further comprises a bleed line that connects the separator to the collector so that at least a portion of the flow through the separator is directed to the collector.

In an embodiment, the apparatus of the present invention comprises an input line connected to a first flow distribution valve that connects the input line to a first inlet line and a second inlet line. The first inlet line connects the first flow distribution valve to a collector. The second inlet line connects the first flow distribution valve to a separator. The collector is connected to a second flow distribution valve disposed downstream thereof. The second flow distribution valve connects the collector to a first outlet line and a return line. The return line connects the second flow distribution valve to the second inlet line. The second flow distribution valve divides a first output stream from the collector into first and second portions whereby the first portion flows through the first outlet line and the second portion flows through the return line to the second inlet line and to the separator. The first flow distribution valve divides the input gas stream into a third portion flowing through the first inlet line to the collector and a fourth portion flowing through the second inlet line to the separator.

In an embodiment, the present invention provides a method for separating particles from a gas stream which comprises the steps of delivering at least part of the gas stream to a collector, dividing an output from the collector into first and second portions, delivering one of the first and second portions to a separator.

In an embodiment, the method of the present invention further comprises the steps of dividing the gas stream into third and fourth portions upstream of both the collector and the separator and delivering one of the third and fourth portions to the separator and the other of the third and fourth portions to the collector.

In an embodiment, the method further comprises the steps of bleeding a fifth portion of a flow through the separator and delivering the fifth portion to the collector.

In an embodiment, the present invention provides a method for improving the efficiency of a system for separating particles from a gas stream which includes a collector such as an electrostatic precipitator. The method comprises the steps of installing a first splitter valve downstream of the collector, connecting the first splitter valve to a separator such as an electrostatically enhanced separator and a first outlet line so that the first splitter valve is connected to the collector, the first outlet line and the separator, and dividing an output from the collector so that a first portion flows to the first outlet line and a second portion flows to the separator.

In an embodiment, the method further comprises the steps of installing a second splitter valve upstream of the collector and the separator, connecting the second splitter valve to the collector and the separator and dividing the gas stream with the second splitter valve so that a third portion flows to the collector and a fourth portion flows to the separator.

In an embodiment, the method of the present invention further comprises the steps of installing a bleed line connecting the separator to a point upstream of the collector so that a bleed flow will flow from the separator to the collector.

Additional features and advantages of the present invention are described in, and will be apparent from, the detailed description of the presently preferred embodiments and from the drawings.

BRIEF DESCRIPTION OF THE FIGURES

The present invention is illustrated more or less diagrammatically in the accompanying figures, wherein.

It should be understood that the drawings are not to scale and that the embodiments are illustrated by graphic symbols, phantom lines, diagrammatic representations and fragmentary views. Details which are not necessary for an understanding of the present invention or which render other details difficult to perceive may have been omitted. It should be understood, of course, that the invention is not necessarily limited to the particular embodiments or illustrated herein.

DETAILED DESCRIPTION OF THE PRESENTLY PREFERRED EMBODIMENTS

Figure 1:
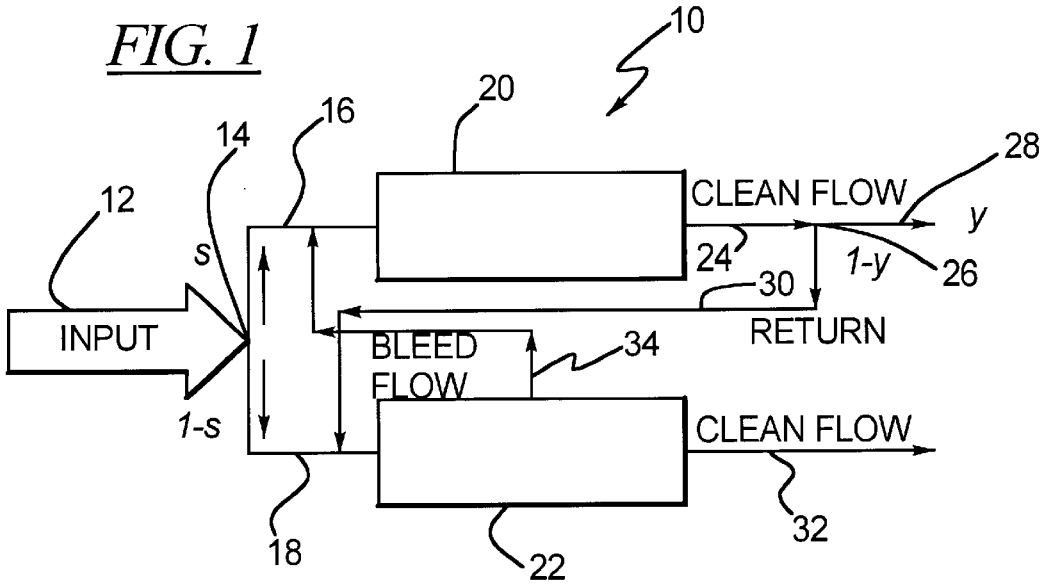
FIG. 1 is a schematic illustration of a particulate control system which includes a collector and which has been upgraded with a separator in accordance with the present invention.

Turning first to FIG. 1, a system 10 includes an input or inlet stream 12 which may be connected to a splitter or divider valve 14. The splitter or divider valve 14, when incorporated, divides the input flow into two portions indicated as s and 1-s. These portions flow through parallel inlet lines 16, 18 to a collector 20 and a separator 22 respectively. The output 24 of the collector 20 is connected to a splitter or divider valve 26. This valve 26 divides the output from the collector 20 into two portions indicated as y, which flows through the outlet line 28 and 1-y which flows through a return line 30 that is connected either to the separator 22 or to the inlet line 18 to the separator 22. The outlet line from the separator 22 is shown at 32. Thus, at least a portion of the flow through the collector 20 is routed through the return line 30 to the separator 22. This combination has been found by the inventors to be an economical and effective means for upgrading the efficiency of a particulate control system that incorporates a collector 20 such as an electrostatic precipitator 20, cyclone collector, bag filter or other suitable collecting device.

In an embodiment, an upstream divider or splitter valve 14 is not necessary and all of the input flow can be directed to the collector 20. Thus, s=1. Further, a bleed line 34 may be employed to connect the separator 22 to the collector 20. Typical flowrate through the bleed line 34 will be 10 percent or less of the total flow through the separator 22.

Figure 2:
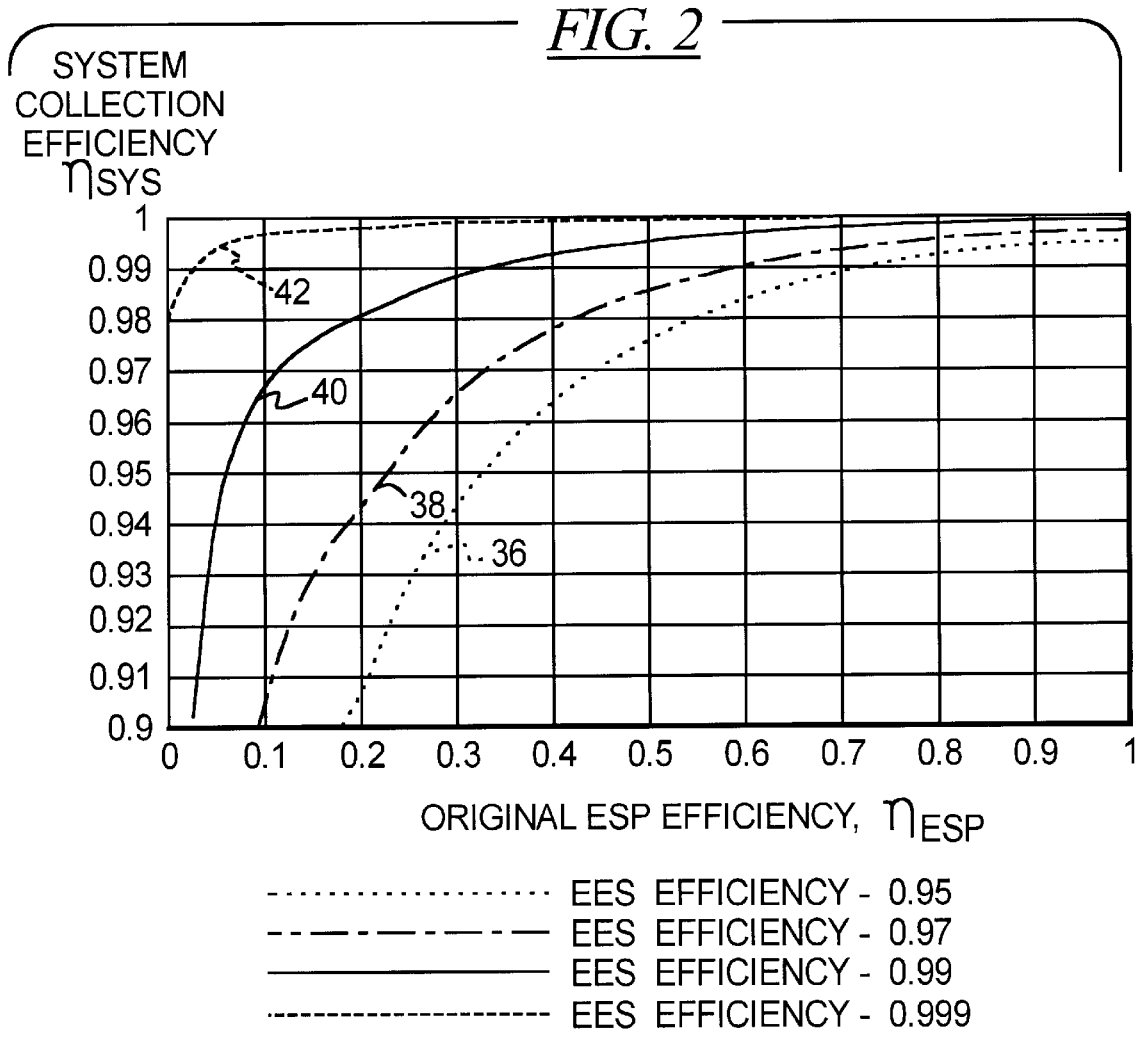
FIG. 2 illustrates, graphically, the overall system efficiency of the system shown in FIG. 1 versus the original electrostatic precipitator efficiency (without the incorporation of an electrostatically enhanced separator) for four fixed electrostatically enhanced separator efficiencies.

FIG. 2 illustrates the improvement of the efficiency of an electrostatic precipitator when connected in parallel to an electrostatically enhanced separator as illustrated in FIG. 1. As shown in FIG. 2, the overall system efficiency $\eta_{SYS}$ is substantially higher than the efficiency of the collector alone, $\eta_{ESP}$. The overall system efficiency $\eta_{SYS}$ is calculated using the following equation:

$$\eta_{SYS} = \eta_{ESP}\frac{s(1-\eta_{EES})+\eta_{EES}}{1-\eta_{EES}(1-\eta_{ESP})(1-y)}$$

Still referring to FIG. 2, the line 36 graphically illustrates the overall efficiency of the system versus the original precipitator efficiency with a fixed separator efficiency of 0.95; line 38 illustrates the overall system efficiency versus the original precipitator efficiency for a fixed separator efficiency of 0.97; line 40 illustrates the overall system efficiency versus the original precipitator efficiency for a fixed separator efficiency of 0.99; and line 42 illustrates the overall system efficiency versus the original precipitator efficiency for a fixed separator efficiency of 0.999.

Figure 3:
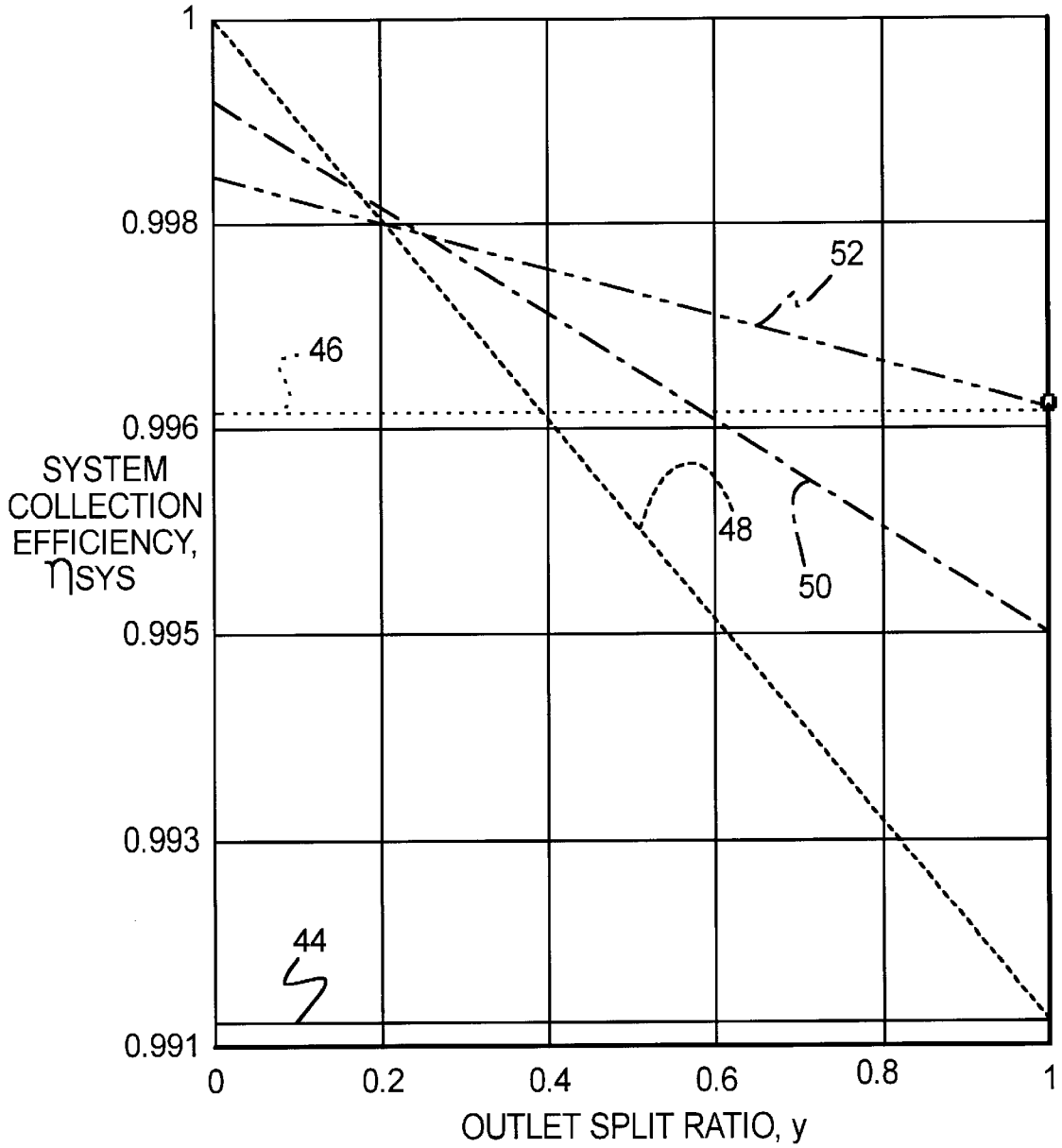
FIG. 3 illustrates, graphically, the overall system efficiency versus the precipitator outlet split parameter y (see FIG. 1) for three fixed precipitator flowrates.
Figure 4:
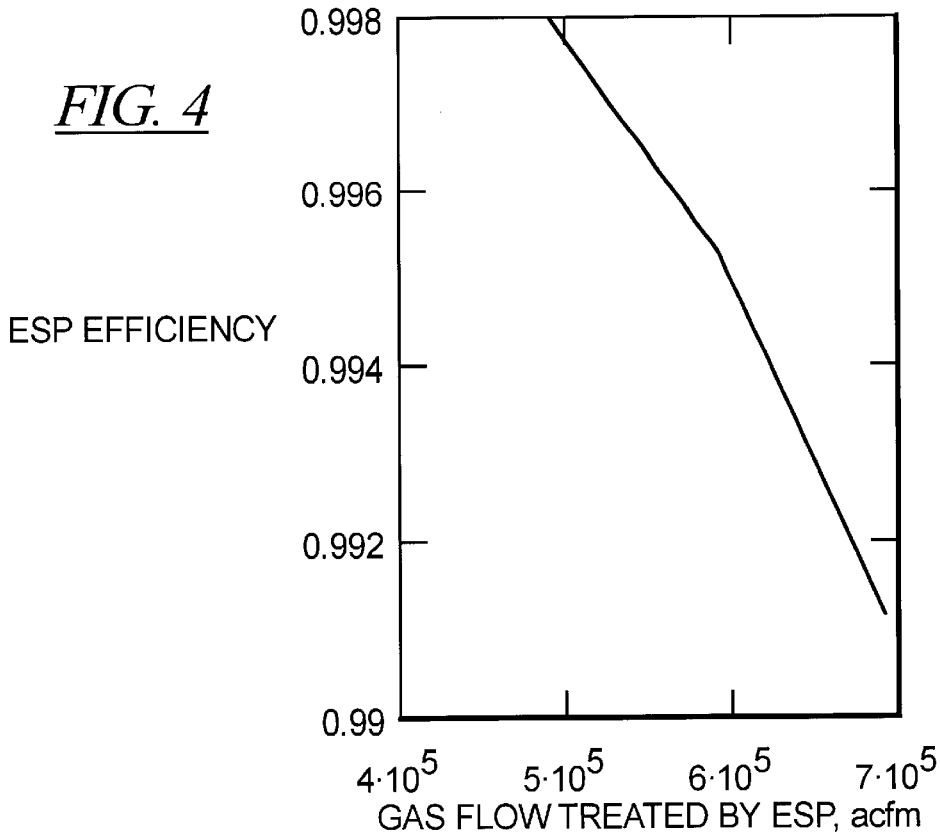
FIG. 4 illustrates, graphically, electrostatic precipitator efficiency versus gas flow.
Figure 5:
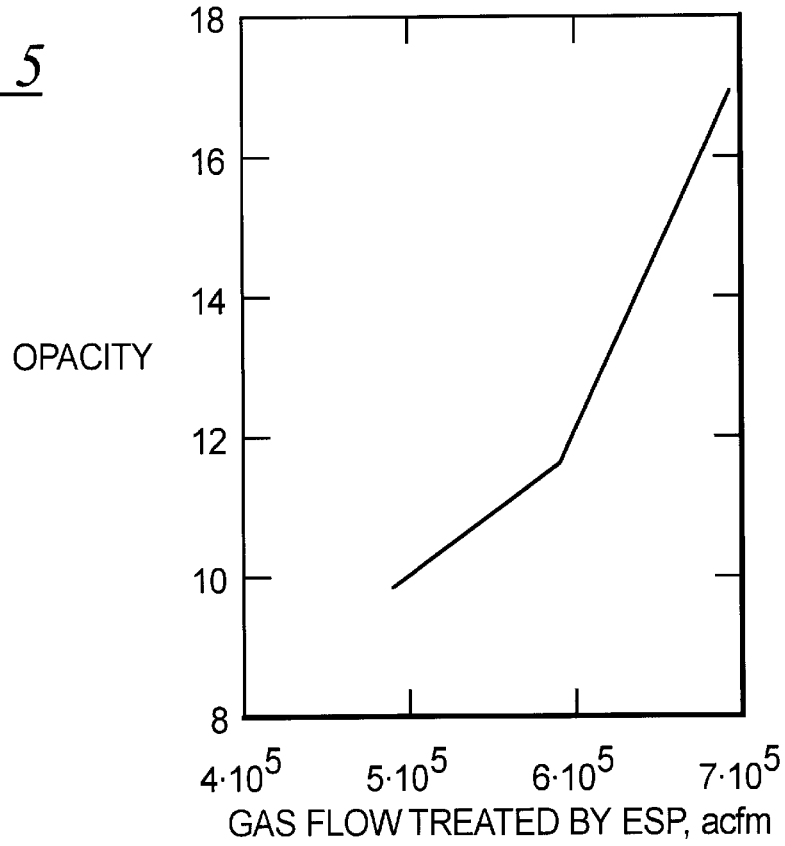
FIG. 5 illustrates, graphically, the opacity of the gas stream versus electrostatic precipitator gas flow.
Figure 6:
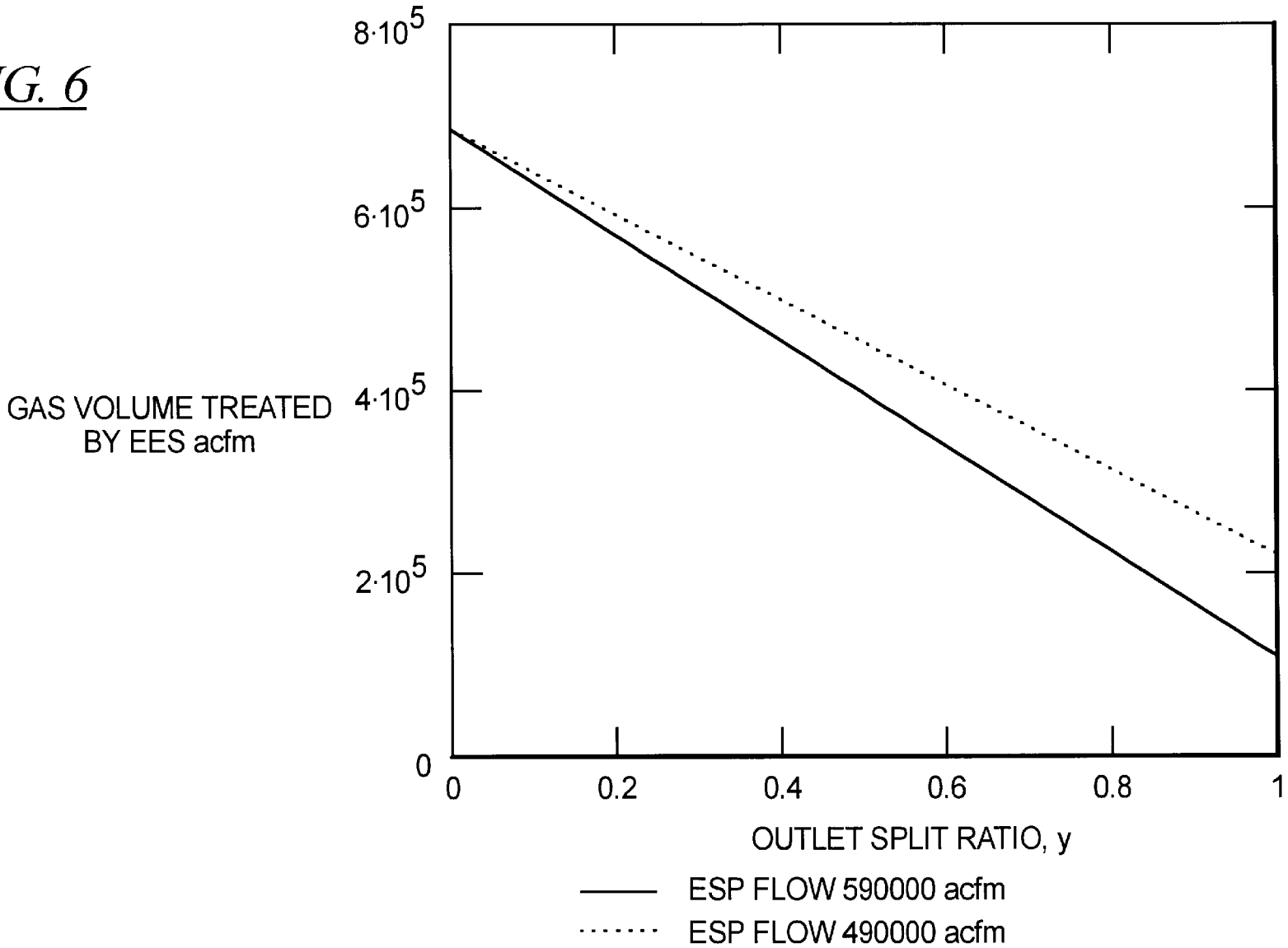
FIG. 6 illustrates, graphically, the gas volume treated by the EES versus the precipitator outlet split ratio y (see FIG. 1).

FIG. 3 illustrates the preferred output split ratio y shown in FIG. 1. Line 44 illustrates the current precipitator efficiency at slightly above 0.991. Line 46 illustrates the target system efficiency corresponding to a 10 percent opacity level. Lines 48, 50 and 52 illustrate the overall system efficiency with fixed precipitator flowrates of 690,000 acfm, 590,000 acfm and 490,000 acfm respectively. Accordingly, with a precipitator flowrate of 690,00, the preferred outlet split ratio y is less than 0.4. With a precipitator flowrate of 590,000 acfm, the preferred output split ratio is less than 0.6. Line 52 illustrates the need for the present invention when the flowrate though the precipitator is greater than 490,000 acfm. Similarly, FIGS. 4 and 5 illustrate the decrease in efficiency of an ESP as the flowrate through the ESP is increased. FIG. 6 illustrates the flowrate directed through the EES versus the outlet split ratio y for two fixed ESP flowrates.

Accordingly, the present invention establishes a low cost method for improving the efficiency of a particulate control system that relies upon a collector such as an electrostatic precipitator (ESP). The present invention can be provided as a convenient retrofit or add-on to current systems without substantial equipment changes. Further, the benefits of the present invention can be realized even when the input split ratio s=1.

The design of electrostatic precipitators are well known to those skilled in the art. The design of electrostatically enhanced separators is described in U.S. Pat. Nos. 5,591,253 and 5,683,494, which are incorporated herein by reference.

It should be understood that various changes and modifications to the presently preferred embodiments described herein will be apparent to those skilled in the art. Such changes and modifications may be made without departing from the scope and spirit of the present invention and without diminishing its attendant advantages. It is therefore intended that such changes and modifications be covered by the appended claims.

What is claimed is:

1. An apparatus for separating particles from a gas stream comprising:

an input line connected to a collector and to a separator, the collector being connected to a first flow distribution valve disposed downstream of the collector, the first flow distribution valve connecting the collector to a first outlet line and a return line, the return line connecting the first flow distribution valve to the separator, the first flow distribution valve dividing a first output stream from the collector into a first portion and a second portion, the first portion flowing through the first outlet line, the second portion flowing through the return line to the separator, a bleed line connecting the separator to the collector so that at least a portion of the flow through the separtor is directed to the collector.

2. The apparatus of claim 1 wherein the collector comprises an electrostatic precipitator.

3. The apparatus of claim 1 wherein the separator comprises an electrostatically enhanced separator.

4. An apparatus for separating particles from a gas stream comprising:

an input line connected to a collector and to a separator, the collector being connected to a first flow distribution valve disposed downstream of the collector, the first flow distribution valve connecting the collector to a first outlet line and a return line, the return line connecting the first flow distribution valve to the separator, the first flow distribution valve dividing a first output stream from the collector into a first portion and a second portion, the first portion flowing through the first outlet line, the second portion flowing through the return line to the separator, wherein the collector comprises an electrostatic precipitator and the separator comprises an electrostatically enhanced separator.

5. The apparatus of claim 4 further comprising a bleed line connecting the separator to the precipitator so that at least a portion of the flow through the separator is directed to the precipitator.

6. An apparatus for separating particles from a gas stream comprising:

an input line connected to a collector and to a separator, the collector being connected to a first flow distribution valve disposed downstream of the collector, the first flow distribution valve connecting the collector to a first outlet line and a return line, the return line connecting the first flow distribution valve to the separator, the first flow distribution valve dividing a first output stream from the collector into a first portion and a second portion, the first portion flowing through the first outlet line, the second portion flowing through the return line to the separator, a second flow distribution valve disposed between the input line and both the collector and the separator, the second flow distribution valve connecting the input line to the collector and the separator, the second flow distribution valve dividing the gas stream into a third portion flowing to the collector and a fourth portion flowing to the separator.

7. An apparatus for separating particles from an input gas stream comprising:

an input line connected to a first flow distribution valve, the flow distribution valve connecting the input line to a first inlet line and a second inlet line, the first inlet line connecting the first flow distribution valve to a collector, the second inlet line connecting the first flow distribution valve to a separator, the collector being connected to a second flow distribution valve disposed downstream thereof, the second flow distribution valve connecting the collector to a first outlet line and a return line, the return line connecting the second flow distribution valve to the second inlet line, the second flow distribution valve dividing a first output stream from the collector into a first portion and a second portion, the first portion flowing through the first outlet line, the second portion flowing through the return line to the second inlet line, the first flow distribution valve dividing the input gas stream into a third portion flowing through the first inlet line to the collector and a fourth portion flowing through the second inlet line to the separator.

8. The apparatus of claim 7 wherein the collector comprises an electrostatic precipitator.

9. The apparatus of claim 7 wherein the separator comprises an electrostatically enhanced separator.

10. The apparatus of claim 7 wherein the collector comprises an electrostatic precipitator and the separator comprises an electrostatically enhanced separator.

11. The apparatus of claim 10 further comprising a bleed line connecting the separator to the precipitator so that at least a portion of the flow through the separator is directed to the precipitator.

* * * * *

UNITED STATES PATENT AND TRADEMARK OFFICE

CERTIFICATE OF CORRECTION

PATENT NO. : 6,372,025 B1
DATED : April 16, 2002
INVENTOR(S) : Burlatsky et al.

It is certified that error appears in the above-identified patent and that said Letters Patent is hereby corrected as shown below:

Column 4,
Line 62, please delete “separtor” and insert -- separator --.

Signed and Sealed this

Third day of September, 2002

*Attest:*

*Attesting Officer*

JAMES E. ROGAN
*Director of the United States Patent and Trademark Office*